US008752237B2

(12) United States Patent
DeJonge

(10) Patent No.: US 8,752,237 B2
(45) Date of Patent: Jun. 17, 2014

(54) FLOOR CLEANER WITH STOWABLE HANDLE

(75) Inventor: Mitchell DeJonge, Fruitport, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 188 days.

(21) Appl. No.: 13/409,668

(22) Filed: Mar. 1, 2012

(65) Prior Publication Data

US 2012/0222234 A1 Sep. 6, 2012

Related U.S. Application Data

(60) Provisional application No. 61/448,461, filed on Mar. 2, 2011.

(51) Int. Cl.
*A47L 7/00* (2006.01)
*A47L 9/32* (2006.01)

(52) U.S. Cl.
USPC ..... 15/320; 15/410; 239/155

(58) Field of Classification Search
USPC ..... 15/320–322, 410; 401/138, 140; 134/117, 118, 172–179, 198, 199, 201; 239/155
See application file for complete search history.

(56) References Cited

U.S. PATENT DOCUMENTS

| | | | | |
|---|---|---|---|---|
| 2,660,457 | A | 11/1953 | Mallon | |
| 4,498,214 | A * | 2/1985 | Oxel | 15/320 |
| 5,417,511 | A * | 5/1995 | Warden | 403/109.5 |
| 5,500,977 | A | 3/1996 | McAllise et al. | |
| 6,167,587 | B1 * | 1/2001 | Kasper et al. | 15/320 |
| 6,658,692 | B2 | 12/2003 | Lenkiewicz et al. | |
| 6,766,559 | B2 | 7/2004 | Roney et al. | |
| 7,048,458 | B2 | 5/2006 | Hall et al. | |
| 7,636,983 | B2 * | 12/2009 | Muhlenkamp | 15/410 |
| 2002/0174507 | A1 * | 11/2002 | Kasper et al. | 15/320 |
| 2005/0091783 | A1 | 5/2005 | Sepke et al. | |
| 2009/0113657 | A1 * | 5/2009 | Haan | 15/322 |
| 2010/0287716 | A1 | 11/2010 | Kasper et al. | |

FOREIGN PATENT DOCUMENTS

| | | | |
|---|---|---|---|
| GB | 2435819 | A | 12/2007 |
| WO | 2004062457 | A2 | 7/2004 |
| WO | 2011019814 | A4 | 2/2011 |

OTHER PUBLICATIONS

Hatinder Sharma, B-1—Chemical Engineering, Patent Examination Report No. 1, 4 pages, Patent Application No. 2012201110, Date of Report: Oct. 21, 2013, Wooden, ACT, Australia.

* cited by examiner

*Primary Examiner* — Mark Spisich
*Assistant Examiner* — Andrew A Horton
(74) *Attorney, Agent, or Firm* — McGarry Bair PC

(57) ABSTRACT

A surface cleaning apparatus comprising a base; an upright handle assembly pivotally mounted to the base and including an upright housing at a lower portion thereof, a handle tube extending upwardly from an upper end of the upright housing and a push rod that is axially slidable within the handle tube; wherein the handle tube is mounted for telescoping movement within upright housing between an extended position and a stowed position within the upright housing; a fluid delivery system including a fluid supply tank for holding a supply of a cleaning fluid; a fluid distributor for distributing the cleaning fluid from the fluid supply tank onto the surface to be cleaned; and a fluid conduit, including a fluid flow controller, between the fluid supply tank and the fluid distributor. A locking collar on the upright housing locks the handle tube in the extended and stowed positions.

14 Claims, 7 Drawing Sheets

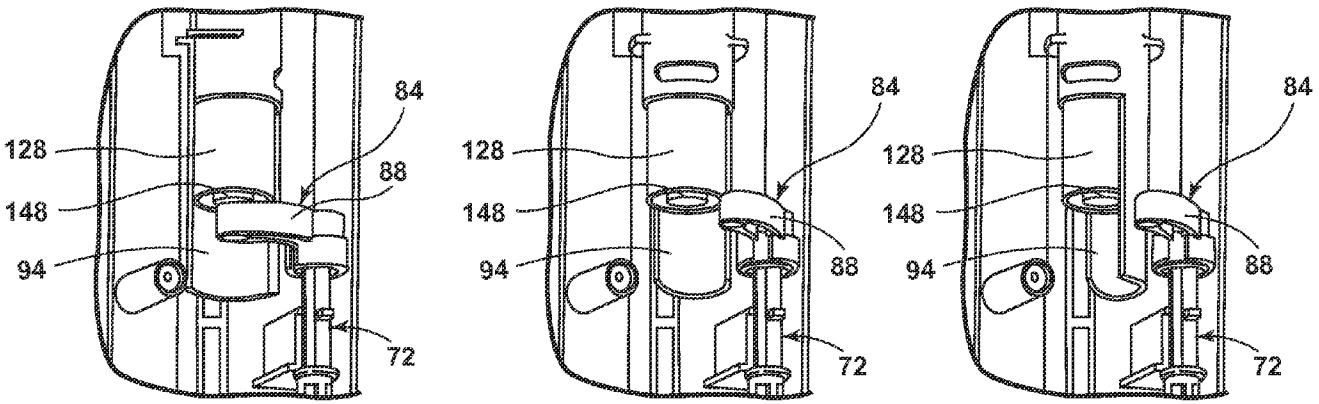
Fig. 9A
Fig. 9B
Fig. 9C
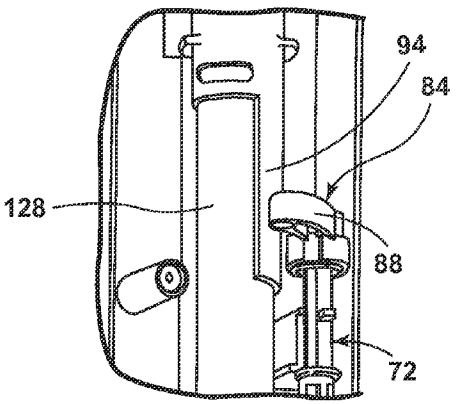
Fig. 9D
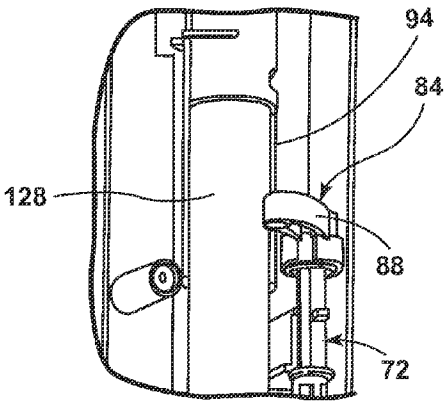
Fig. 9E

FLOOR CLEANER WITH STOWABLE HANDLE

CROSS REFERENCE TO RELATED APPLICATIONS

This application claims the benefit of U.S. Provisional Patent Application Ser. No. 61/448,461, filed Mar. 2, 2011, which is incorporated herein by reference in its entirety.

BACKGROUND OF THE INVENTION

The invention relates to surface cleaning. In one of its aspects, the invention relates to a floor surface cleaning machine with a stowable handle. In another of its aspects, the invention relates to a handle for an upright floor cleaning machine that is configured to selectively stow and extend along its axis. In yet another of its aspects, the invention relates to a floor cleaning machine that has a fluid distribution system in which fluid is dispensed with a handle-operated push rod for applying a cleaning fluid to a floor surface, such as a bare floor or a carpet, wherein the handle is selectively collapsible for shipping and/or stowage. In another of its aspects, the invention relates to a floor cleaning machine that has a fluid distribution system and a stowable handle that can be locked in the extended and stowed positions. In another of its aspects, the invention relates to a steam cleaning machine with a stowable handle. In another of its aspects, the invention relates to an extraction cleaning machine with a stowable handle. In another of its aspects, the invention relates to a wet mop with a stowable handle.

U.S. Pat. No. 6,658,692 discloses an extraction cleaning machine comprising a fluid delivery system with a cleaning fluid supply tank for storing a cleaning fluid mounted on an upright handle housing, a fluid distributor for applying the cleaning fluid to the surface to be cleaned, and a fluid supply conduit for supplying the fluid from the supply tank to the fluid distributor. A flow control valve in mounted in the fluid supply conduit and is controlled by push rods that are mounted for axial movement within the upright handle housing and a trigger on a handle. Other extraction cleaning machines with similar mechanical control systems for gravity flow are disclosed in U.S. Pat. No. 5,500,977.

US2010/0287716 discloses bare floor cleaner that includes an upright handle assembly pivotally mounted to a base through a swivel mounting and includes a handle housing. A water tank is mounted to the handle housing and is adapted to hold a quantity of water. A fluid distribution system is located between the water tank and the fluid distributor for distributing fluid from the water tank to the surface to be cleaned. Further, the fluid distribution system includes a heating element for heating the water from the water tank to steam, whereby the steam is distributed to the surface to be cleaned. The upper handle portion has a grip, a trigger, a handle tube and a push rod within the handle tube that actuates a microswitch, which selectively energizes a solenoid valve in the fluid distribution system to control the flow of water to a steam generator for application to the bare floor surface to be cleaned. Other bare floor steam cleaners with similar fluid distribution control systems are disclosed in WO2011019814.

A wet mop with a similar fluid distribution control system is disclosed in U.S. Pat. No. 7,048,458.

In all of these floor cleaning appliances, a handle tube with a hand grip on the upper end extends from an upper end of a handle housing and the push rods are axially slidable in the handle tube. In view of the internal push rods, the handle tube cannot be collapsed into the handle housing for shipping or stowage.

BRIEF DESCRIPTION OF THE INVENTION

According to the invention, a surface cleaning apparatus comprises a base, which is adapted to move along a surface to be cleaned; an upright handle assembly pivotally mounted to the base and including an upright housing at a lower portion thereof, a handle tube extending upwardly from an upper end of the upright housing and a push rod that is axially slidable within the handle tube; wherein the handle tube is mounted for axial movement within upright housing between an extended position in which at least a portion of the handle tube extends outside of the upright housing and a stowed position in which the portion of the handle tube is received within the upright housing; and a fluid delivery system including a fluid supply tank for holding a supply of a cleaning fluid, a fluid distributor for distributing the cleaning fluid from the fluid supply tank onto the surface to be cleaned and a fluid conduit, including a fluid flow controller, between the fluid supply tank and the fluid distributor.

As used herein, the term "pivotally mounted" with respect to the connection to the base and the upright handle assembly means a mounting of the upright handle to the base for rotation about a single axis or multiple axes. A single mounting is typically used in an extraction cleaning machine and multiple axes mountings, for example, universal joints or swivel joints, are typically used in steam mops and in wet mops.

In one embodiment, the upright handle assembly further comprises a connector that is mounted for selective movement between a connected position, in which the push rod and the fluid flow controller are connected for selective control of the fluid flow controller, and a disconnected position, in which the push rod and the fluid flow controller are disconnected. The connector can be in the connected position when the handle tube is in the extended position and can be in the disconnected position when the handle tube is in the stowed position. The connector can be a lever that is pivotally mounted for movement between an aligned position in which it is in registry with the push rod and a misaligned position in which it is out of registry with the push rod.

In another embodiment, the upright handle assembly can have a handle grip mounted to an upper end of the handle tube and a manual actuator that is connected to the push rod for selective axial movement of the push rod when the handle tube is in the extended position for controlling the flow of fluid between the fluid supply tank and the distributor.

In one embodiment, the fluid flow controller is a valve. In addition, the valve can be a mechanically operated valve that is opened by axial movement of the push rod when the connector is in the connected position. Alternatively, the valve can be an electrically operated valve that is opened by axial movement of the push rod when the connector is in the connected position.

In another embodiment, the upright housing can include a collar that is mounted to the upper end thereof for rotational motion and that can receive the handle tube in a central opening thereof. In addition, a sheath can be rotationally mounted to the collar, at least partially surrounding the push rod, and keyed to the collar for rotation therewith. The sheath can include a cam rib that is configured to operably contact and move the lever between the aligned position and the misaligned position. In addition, the lever can be biased into the aligned position.

In one embodiment, the fluid distributor can include a steam generator in the fluid conduit and the fluid distributor can be configured to deliver steam to the surface to be cleaned.

In another embodiment, the surface cleaning apparatus can include a fluid recovery system for recovering soiled cleaning fluid from the surface to be cleaned.

Typically, the fluid supply tank can be mounted to the upright handle assembly. In another embodiment, the upright housing can include a locking mechanism to selectively lock the handle tube in at least one of the extended and stowed positions. The locking mechanism can include a locking collar that is rotatably mounted to the upright housing and that receives the handle tube in a central opening of the collar.

BRIEF DESCRIPTION OF THE DRAWINGS

In the drawings:

FIG. 9A-9E are partial perspective views of a portion of the connection between the push rod, sheath and engagement lever in successive positions of the sheath, engagement lever and the handle tube between a locked extended position and locked in stowed position.

DESCRIPTION OF EMBODIMENTS OF THE INVENTION

The drawings will be described with respect to an extraction cleaning machine in which a fluid flow controller in mounted in a fluid supply conduit and is controlled by push rods that are mounted for axial movement within an upright handle housing and a trigger on a handle as described, for example, in U.S. Pat. No. 6,658,692 and U.S. Pat. No. 5,500,977, which are incorporated herein by reference in their entirety, for disclosing an example of an embodiment of the invention. However, it will be apparent that the invention is not limited to extraction cleaning machines but is equally applicable to steam mop floor cleaning machines of the type as disclosed, for example, in WO2011019814 and US2010/0287716, which are incorporated herein by reference in their entirety. In addition, the invention is also equally applicable to wet mops of the type disclosed, for example, in U.S. Pat. No. 7,048,458, which is also incorporated herein by reference in its entirety.

Figure 1:
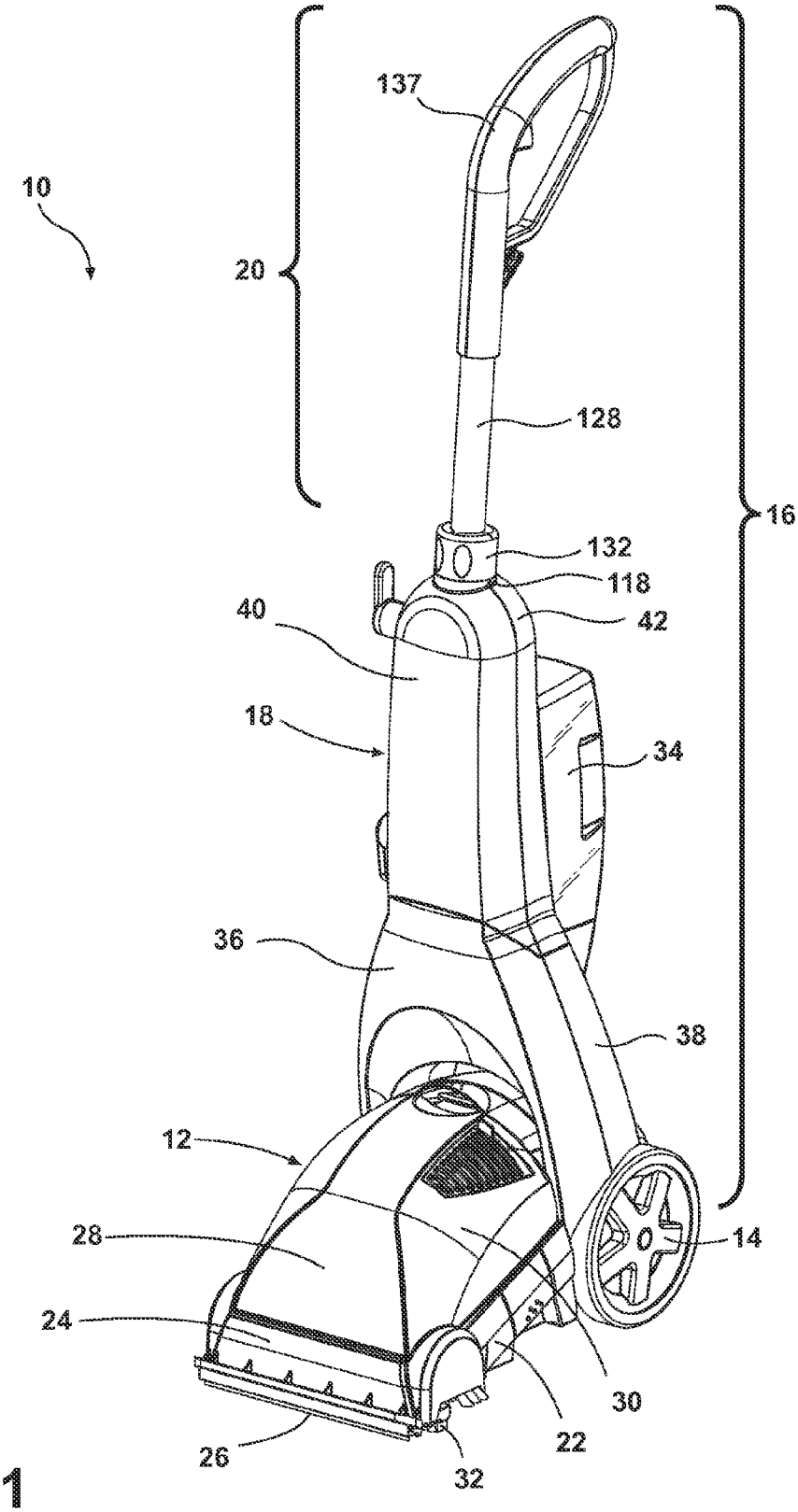
FIG. 1 is a front perspective view of an upright extractor according to the invention.
Figure 2:
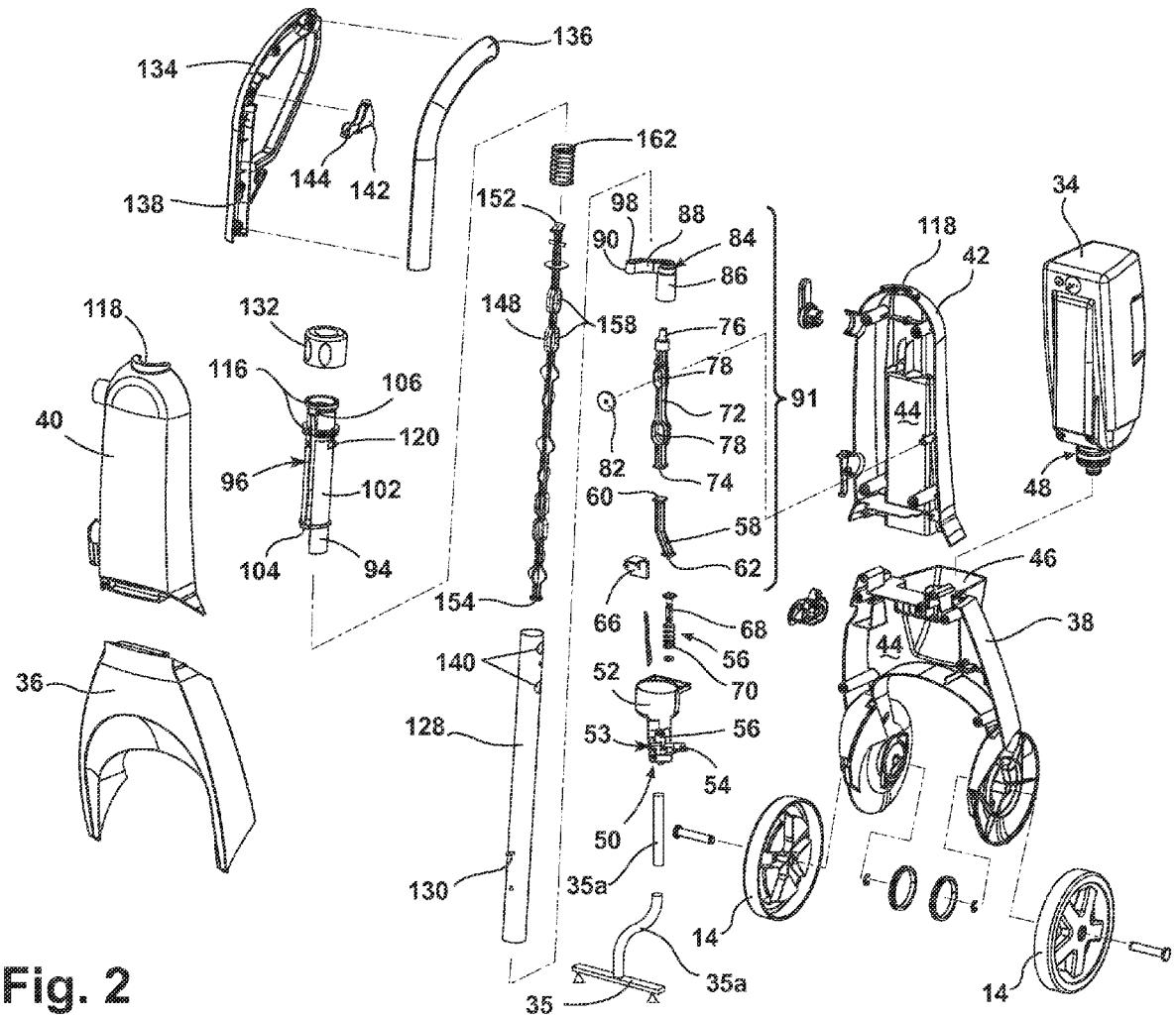
FIG. 2 is a partial exploded perspective view of a handle assembly of FIG. 1.

Referring now to the drawings, and in particular to FIGS. 1-2, an embodiment of the invention is illustrated comprising an extraction cleaning machine 10 of the type disclosed in the U.S. Pat. No. 6,658,692 to Lenkiewicz et al. and comprising a base module 12 adapted with wheels 14 to roll across a surface to be cleaned, and an upright handle assembly 16 pivotally mounted to a rear portion of the base module 12. The upright handle assembly 16 further comprises a handle housing 18 and a selectively stowable and lockable upper handle assembly 20 slidably mounted thereto. The base module 12 is generally well-known and is more fully described in U.S. Pat. No. 6,658,692 to Lenkiewicz et al. Such well-known features and operations will not be described in detail herein, except as otherwise necessary for a complete understanding of the invention.

As shown in FIG. 1, the base module 12 comprises a generally rectangular-shaped base member 22 that is adapted to support and mount several components. A suction nozzle 24 is removably mounted along the front of the base module 12 with an inlet 26 in register with the cleaning surface. The suction nozzle 24 is fluidly connected to a working air conduit 28, which is fluidly connected to a recovery tank 30 through and intermediate suction source, such as a conventional motor/blower assembly (not shown). Alternatively, a "clean air" system is contemplated such that a motor/impeller assembly is positioned downstream from the recovery tank. An agitator assembly 32 is rotatably mounted behind the suction nozzle 24. A fluid delivery system comprises a fluid supply tank 34 for storing a cleaning fluid, a fluid distributor 35 (FIG. 2) mounted beneath a forward portion of the base module 12 and adapted to selectively apply cleaning fluid from the supply tank 34 onto the surface to be cleaned via a fluid supply conduit 35*a* (FIG. 2) comprising conventional tubing or the like.

Figure 3:
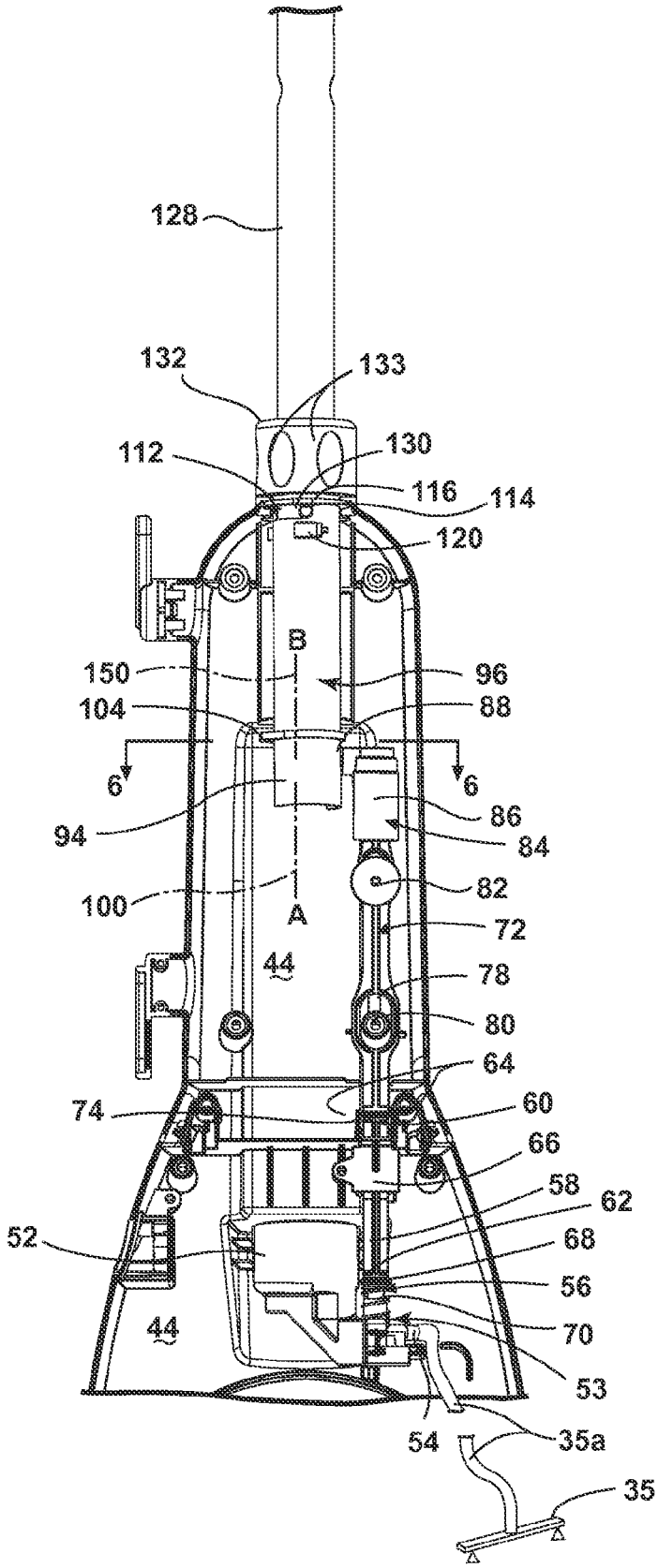
FIG. 3 is a partial front view of the handle assembly of FIG. 1 with a front housing removed and the handle assembly extended and locked in the upright position.
Figure 4:
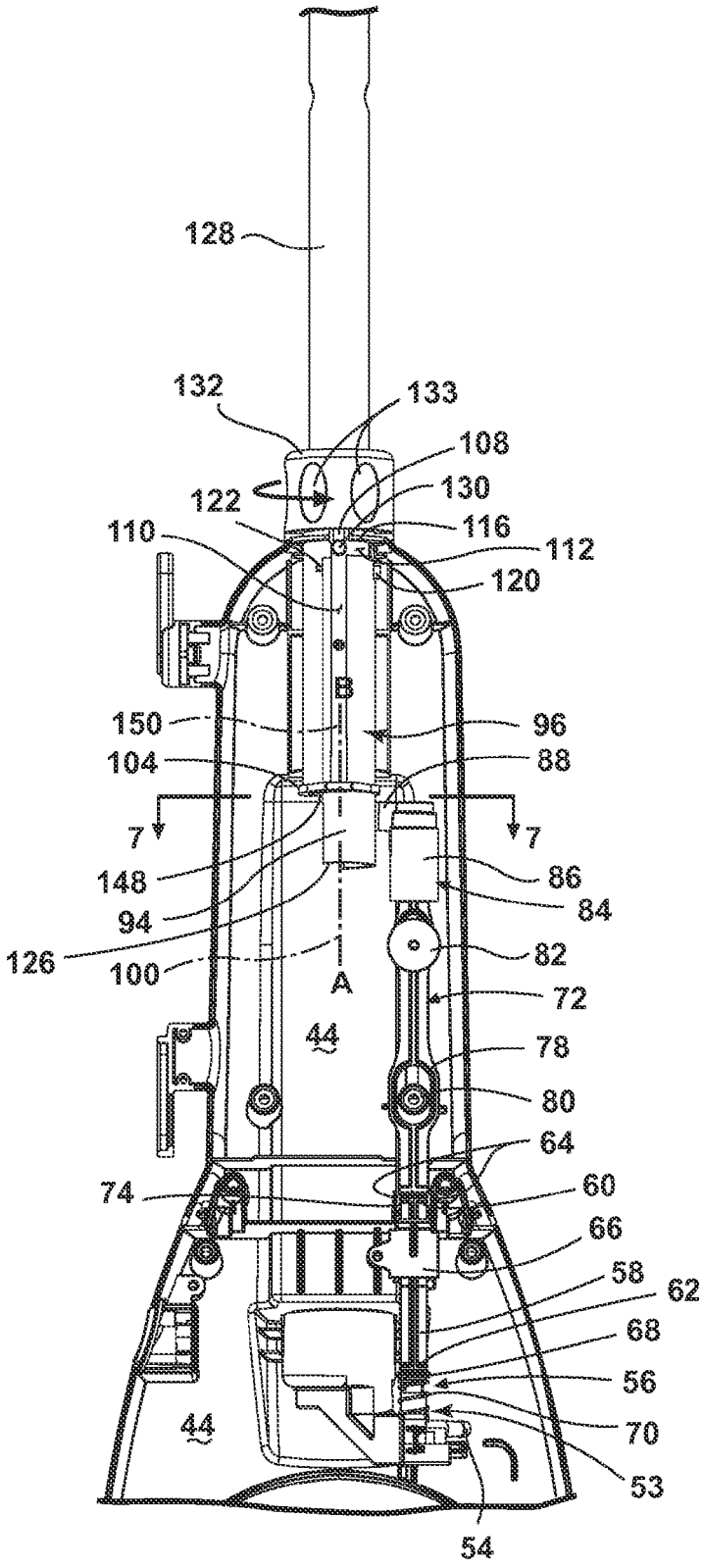
FIG. 4 is a partial front view of the handle assembly of FIG. 1 with front housings removed and the handle assembly unlocked and prepared for stowage.

Referring to FIGS. 2-3, the upright handle assembly 16 comprises a handle housing 18 further comprising a lower front housing 36 and lower rear housing 38 as well as an upper front housing 40 and upper rear housing 42 fastened together to form a cavity 44 therebetween. The individual housings 36, 38, 40, 42 can further comprise assorted ribs, bosses, for mounting and guiding internal components within the cavity 44. A recessed mounting platform 46 on the back of the lower rear housing 38 is adapted to selectively receive a fluid supply tank 34 therein.

The fluid delivery system includes the fluid supply tank 34 for holding a supply of a cleaning fluid, a fluid distributor 35 for distributing the cleaning fluid from the fluid supply tank onto the surface to be cleaned and a fluid conduit 35*a*, including a fluid flow controller 53, between the fluid supply tank 34 and the fluid distributor 35. The fluid supply tank 34 comprises an outlet valve 48 that is configured to selectively open when the outlet valve 48 is mounted to a tank receiver 50 that is mounted within handle housing 18, accessible through the top of the recessed mounting platform 46. The tank receiver 50 comprises a cylindrical cup 52 that is adapted to sealingly receive the outlet valve 48. The tank receiver 50 further comprises the fluid flow controller 53 in an internal conduit (not shown) from the cup 52 to an outlet barb 54. The fluid flow controller comprises an integral plunger valve 56 that is interposed between the cup 52 and the outlet barb 54 and is configured to be selectively actuated by a lower push rod 58. The outlet barb 54 is fluidly connected to the fluid distributor 35 via the fluid supply conduit 35*a*.

As best shown in FIG. 3, the lower push rod 58 comprises an elongate member with a flat upper end 60 and a lower end 62. The lower push rod 58 is slidably retained between a pair of guide ribs 64 inside the lower rear housing 38 by a bracket 66 that is fastened to the lower rear housing 38. The guide ribs 64 and bracket 66 are configured to provide some clearance around the lower push rod 58 to permit the lower push rod 58 to slide vertically relative to the plunger valve 56. The plunger valve 56 is normally biased in the closed position and further comprises a plunger 68 that is normally biased upwardly by a valve spring 70 when the plunger valve 56 is closed. The lower end 62 of the lower push rod 58 is in register with the plunger 68. Accordingly, the lower push rod 58 is normally biased upwardly by the spring biased plunger 68 when the plunger valve 56 is closed.

An intermediate push rod 72 is slidably mounted to the upper rear housing 42. The intermediate push rod 72 comprises a generally elongate member with a flat lower end 74, a cylindrical stepped upper end 76, and a cross-shaped rib profile therebetween. Elongate slots 78 are formed near the opposed ends of the intermediate push rod 72 and are mounted for axial sliding movement within two corresponding guide bosses 80 that protrude inwardly from the rear wall of the upper rear housing 42. The elongate slots 78 guide the intermediate push rod 72 in vertical sliding movement relative to the guide bosses 80. The intermediate push rod 72 is laterally retained to the upper rear housing 42 by a retention washer 82 that is fastened to the upper guide boss 80 via a conventional fastener. The diameter of the retention washer 82 is larger than the width of the elongate slot 78, and thereby slidingly retains the intermediate push rod 72 to the lower rear housing 38. The lower end 74 of the intermediate push rod 72 is in register with the upper end 60 of the lower push rod 58.

A spring biased push rod engagement lever 84 is rotatably mounted to the cylindrical stepped upper end 76 of the intermediate push rod 72. The engagement lever 84 comprises a vertically oriented cylindrical body portion 86 comprising internally stepped walls that correspond to the stepped upper end 76 of the intermediate push rod 72. An arcuate lever arm 88 protrudes outwardly from the top portion of the cylindrical body portion 86 along a horizontal plane and terminates at a cantilevered end 90. The inner wall of the arcuate lever arm 88 forms a cam follower 92 that is adapted to selectively engage a corresponding cam rib 94 on the lower end of a rotatable sheath 96, which will be described hereinafter. The cantilevered end 90 further comprises a cylindrical pad 98 with a vertically-oriented axis "A." A torsion spring (not shown) is mounted between the stepped upper end 76 of the intermediate push rod 72 and the cylindrical body portion 86 and normally biases the arcuate lever arm 88 and cylindrical pad 98 forwardly, towards the front wall of the upper front housing 40 and into a registry position with respect to a upper push rod 148. The engagement lever 84 is rotatably retained to the cylindrical stepped upper end 76 of the intermediate push rod 72 via a conventional washer-head screw fastener (not shown). Thus, the lower push rod 58, the intermediate push rod 72 and the engagement lever form as described above provide a connector 91 between the upper push rod 148 and the fluid flow controller 53 that is mounted for selective movement between a connected position, in which the push rod 148 and the fluid flow controller 53 are connected for selective control of the fluid flow controller 53, and a disconnected position, in which the push rod 148 and the fluid flow controller 53 are disconnected as will be described in more detail below.

Now referring to FIGS. 3-8, a description of the upper handle assembly 20 follows. A rotatable sheath 96 comprises a cylindrical body 102, a keyed lower support ring 104 and a keyed upper end 106 with a resilient retention detent tab 108. The cylindrical body 102 further comprises an elongate vertical guide track 110 formed through the cylindrical sidewall and extending from the keyed lower support ring 104 to the retention detent tab 108. The top of the vertical guide track 110 adjoins a horizontal guide track 112 that extends partially around the perimeter of the cylindrical body 102 and terminates at a stop 114. The sheath 96 further comprises a pair of spaced, horizontally oriented, circular ribs 116 (FIG. 2) near the top of the sheath that are configured to be rotatably retained by a neck 118 (FIGS. 1, 2) that is formed by opposed housing walls when the upper front housing 40 and upper rear housing 42 are fastened together, thereby cradling the sheath 96. A first and second sheath stop tab 120, 122, protrude outwardly from an upper portion of the cylindrical body 102 and are spaced apart around the perimeter by approximately 90 degrees. The first and second sheath stop tabs 120, 122 alternately engage a corresponding stop ribs 123, (FIG. 6) protruding inwardly from the upper front housing 40, when the sheath 96 is rotated to its clockwise and counterclockwise position limits. A cam rib 94 extends downwardly from the keyed lower support ring 104 and comprises a partial cylindrical rib with a vertical contact edge 124 and a bottom edge 126 that lies along a generally horizontal plane. The cam rib 94 is adapted to selectively abut the cam follower 92 on the inner wall of the arcuate lever arm 88 and move it from the position shown in FIG. 6 to the position shown in FIG. 8.

The sheath 96 is sized to slidably receive a stowable handle tube 128 therein. The handle tube 128 can comprise rolled, welded steel, aluminum or extruded plastic, for example. The handle tube 128 further comprises a fixed locking pin 130 that protrudes outwardly from a lower front portion of the handle tube 128.

To assemble the sheath 96 to the handle tube 128, the keyed upper end 106 of the sheath 96 is aligned with the locking pin 130 on the handle tube 128. Next, the handle tube 128 is pushed downwardly into the sheath 96 until the locking pin 130 slides past the resilient retention detent tab 108, which temporarily deflects the retention detent tab 108 outwardly until the locking pin 130 clears the detent tab 108 and enters the vertical guide track 110. The resilient retention detent tab 108 then springs back to its original position, which blocks the locking pin 130 and prevents the handle tube 128 from being inadvertently separated from the sheath 96.

A locking collar 132 is permanently affixed to the top portion of the sheath 96 by ultrasonic welding or any another suitable manufacturing process, such as adhesive or mechanical fastening, for example. Accordingly, when a user rotates the locking collar 132, the sheath 96 rotates in unison. The locking collar 132 further comprises a hole in the top wall to accommodate the handle tube 128 and a plurality of depressions 133 formed in the outer surface to enhance the grip of a user who engages the locking collar 132. Alternatively, the collar 132 can comprise elastomeric features that are overmolded or otherwise secured to the outer surface thereof to provide a comfortable and easy to grip user interface.

A handle grip 134 and grip cover 136 are fastened together to form a grip assembly 137 that cradles the upper portion of the handle tube 128. Bosses 138 formed within the grip and grip cover are received in holes 140 in the upper portion of the handle tube 128. A trigger 142 is pivotally mounted within mounting bosses (not shown) formed between the grip 134 and grip cover 136. A proximal end 144 of the trigger 142 is in register with and adapted to selectively abut a flat upper end 152 of an upper push rod 148 that is slidably mounted within the handle tube and adapted for vertical movement along a push rod axis "B." The upper push rod 148 is an elongate member that extends along the length of the handle tube 128 and into the grip assembly 137. The upper push rod 148 comprises a flat upper end 152 and a flat lower end 154 interconnected by a body 156 that further comprises a pair of elongate slots 158. The elongate slots 158 fit around guide bosses 138 inside the grip 134, which limit the upper and lower positions of the upper push rod 148. A coil spring 162 is mounted to the upper portion of the upper push rod 148 and normally biases the rod 148 in an upward position. Hence, the flat upper end 152 of the upper push rod 148 forces the proximal end 144 of the trigger 142 upwardly.

In operation, a user prepares the extraction cleaning machine 10 by filling the fluid supply tank 34 with cleaning fluid and mounting the fluid supply tank 34 onto the tank receiver 50, which opens the outlet valve 48 and delivers fluid into the fluid delivery system, upstream from the plunger valve 56. The handle tube is locked in the extended position and the engagement lever is in the position illustrated in FIGS., 3, 6 and 9A. After connecting the machine to a power source and energizing it, the suction source generates a working airflow through the fluid recovery system as previously described. A user can push and pull the extraction cleaning machine 10 in a forward and backward motion across the surface to be cleaned while selectively applying and extracting cleaning fluid and debris thereon. To apply fluid to the cleaning surface, a user depresses the trigger 142, which forces the proximal end 144 downwardly against the flat upper end 152 of the upper push rod 148, thus compressing the coil spring 162 that normally biases the upper push rod upwardly. The upper push rod 148 slides downwardly and the flat lower end 154 pushes the cylindrical pad 98 on the arcuate lever arm 88 of the engagement lever 84 downwardly. The engagement lever 84, in turn, transmits the downward displacement to the intermediate push rod 72. The elongate slots 78 slide downwardly around the guide bosses 80 and the flat lower end 74 thereof depresses the lower push rod 58. The lower push rod 58 slides downwardly between the guide ribs 64 and bracket 66. The lower end 62 thereof depresses the plunger 68, which opens the plunger valve 56 and permits cleaning fluid to flow from the fluid supply tank through a fluid conduit (not shown), through the valve 56 and downstream fluid distributor (not shown) onto the surface to be cleaned. Optionally, the agitator 32 can be selectively energized continuously or intermittently during the cleaning cycle to enhance the cleaning process.

Figure 5:
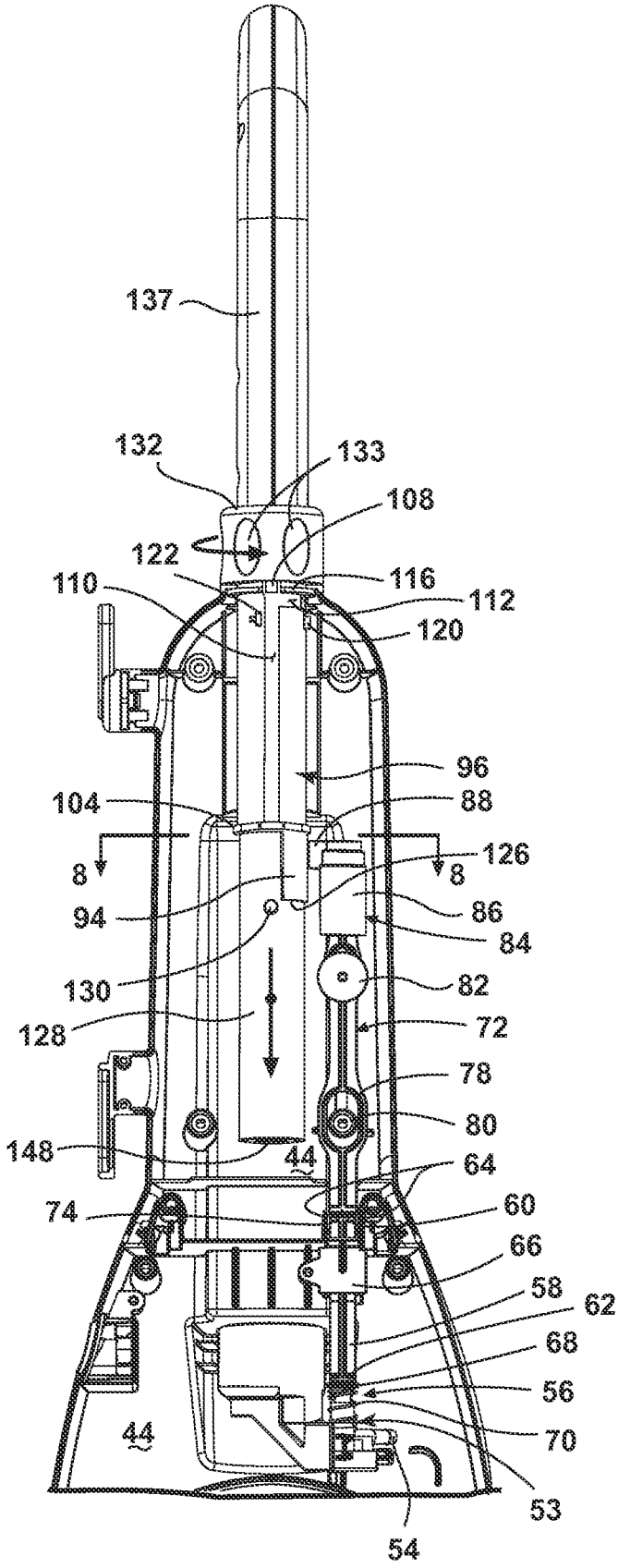
FIG. 5 is a partial front view of the handle assembly of FIG. 1 with front housings removed and the handle assembly in the stowed position.
Figure 6:
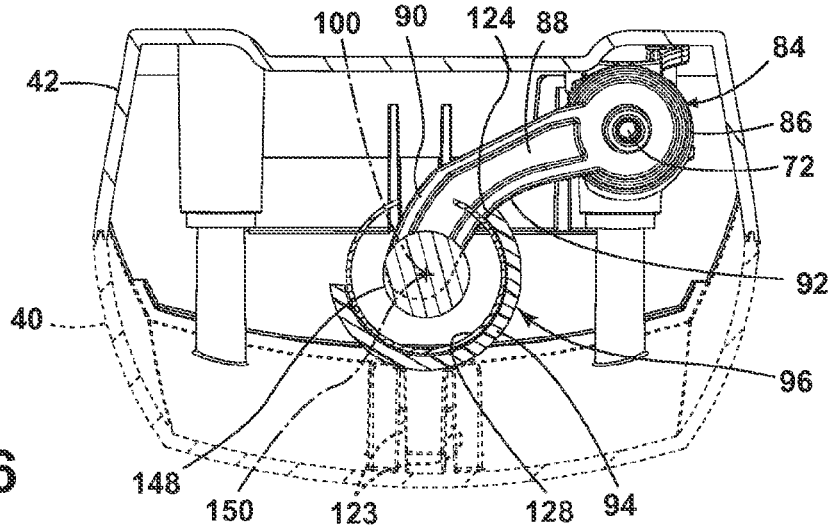
FIG. 6 is a cross-sectional view of the handle assembly of FIG. 3 taken along line 6-6.
Figure 7:
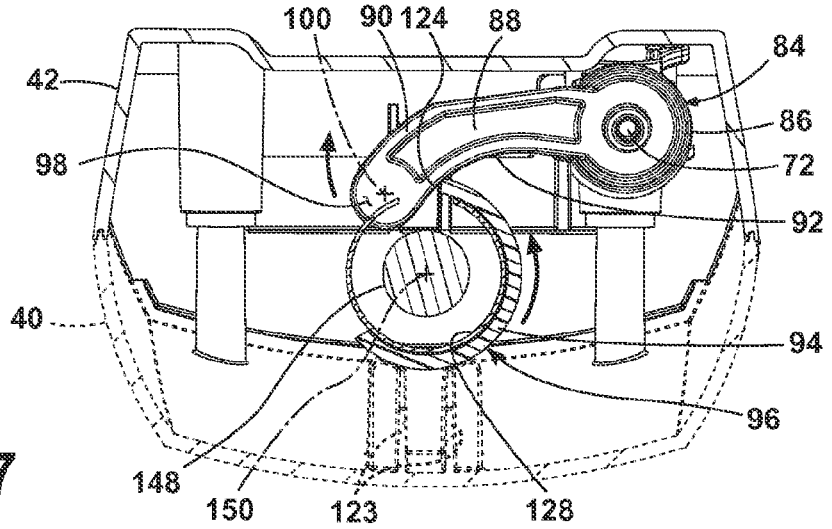
FIG. 7 is a cross-sectional view of the handle assembly of FIG. 4 taken along line 7-7, and showing the transitional positions of the sheath and engagement lever as the locking collar is rotated to prepare the handle for stowage from an upright position.
Figure 8:
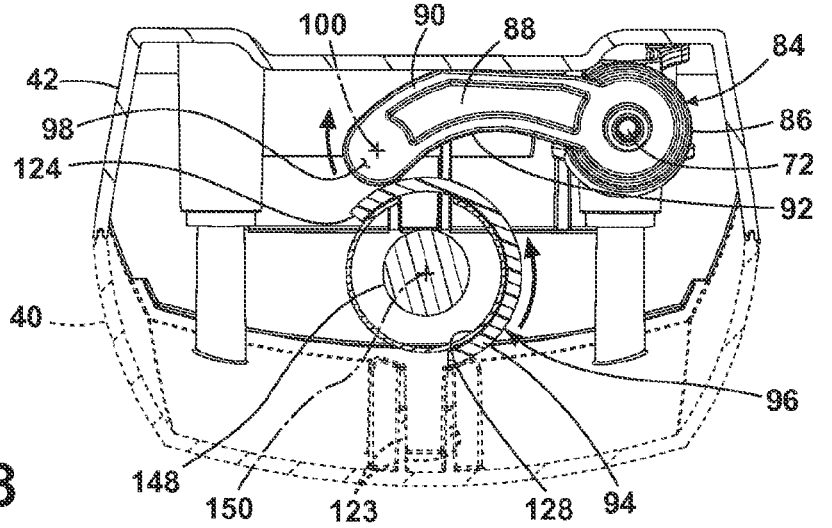
FIG. 8 is a cross-sectional view of the handle assembly of FIG. 5 taken along line 8-8 and showing the positions of a sheath and engagement lever after the locking collar has been rotated to a disengaged position for handle stowage within the upright housing.

Upon completing a cleaning task, for example, a user can stow the upper handle assembly 20 as illustrated in FIGS. 5 and 8. When the upper handle 20 is in the extended, locked position, a user first twists the locking collar 132 counterclockwise, which, in turn, twists the associated rotatable sheath 96 in unison. The sheath 96 rotates counterclockwise relative to the handle tube 128 until the second sheath stop tab 122 contacts the stop rib 123 on the upper front housing 40 as illustrated in FIG. 9B. The horizontal guide track 112 slides counterclockwise relative to the locking pin as viewed in FIGS. 7 and 8 to rotate the stop 114 of the horizontal guide track 110 away from the locking pin 130 until the locking pin 130 eventually becomes aligned with the vertical guide track 110. Moreover, as the sheath 96 rotates, the contact edge 124 of the cam rib 94 contacts the cam follower 92 on the engagement lever 84 and moves the cam follower 92 rearwardly as illustrated in FIGS. 7 and 8, pivoting the cylindrical body portion 86 about the cylindrical stepped upper end 76 of the intermediate push rod 72 and compresses the torsion spring (not shown) mounted therein. As the sheath 96 continues to rotate in a counterclockwise direction as viewed in FIGS. 7 and 8, the cam follower 92 slides along the outer surface of the cam rib 94 until the arcuate lever arm 88 is completely outside the outer diameter of the sheath 96 as illustrated in FIG. 9C and the cylindrical pad 98 is no longer aligned with the upper push rod 148 along their respective axes, "A" 100 and "B" 150. Hence, the lower end 154 of the upper push rod 148 is no longer aligned or in register with the cylindrical pad 98 of the engagement lever 84 and the handle tube 128 is free to slide downwardly within the sheath 96.

With the locking pin 130 aligned in the vertical guide track 110 and the engagement lever 84 pushed rearwardly by the cam rib 94, a user may push the grip assembly 137 and associated handle tube 128 downwardly within the handle housing 18. The handle tube 128 slides vertically within the sheath 96 and the locking pin 130 slides downwardly within the vertical guide track 110 until it passes through the keyed lower support ring 104 as illustrated in FIG. 9D. The locking pin 130 continues to slide downwardly past the bottom edge 126 of the cam rib 94 until the lower portion of the grip assembly 137 contacts the locking collar 132 (FIG. 5).

Next, the user can lock the upper handle assembly 20 in the stowed position by twisting the locking collar 132 in the clockwise direction until the first sheath stop tab 120 contacts the stop rib 123 in the upper front housing 40. In this position, the top of the locking pin 130 is retained by the bottom edge 126 of the cam rib 94 so that the upper handle assembly 20 cannot be extended without first twisting the locking collar in the counterclockwise direction as illustrated in FIG. 9E.

To extend the upper handle assembly 20, a user twists the locking collar 132 in a counterclockwise direction as viewed in FIGS. 7 and 8 until the second sheath stop tab 122 contacts the corresponding stop rib 123. In this position, the locking pin 130 clears the bottom edge 126 of the cam rib 94 and is aligned with the keyed lower support ring 104 and vertical guide track 110 (see FIG. 5). Accordingly, the user can pull upwardly on the grip assembly 137, which pulls the associated handle tube 128 upwardly within the sheath 96. The locking pin 130 slides through the keyed lower support ring 104 and along the vertical guide track 110 until it contacts the retention detent tab 108. In this vertical position, the locking pin 130 is aligned with the horizontal guide track 112. Accordingly, to lock the upper handle assembly 20 in the extended position, a user twists the locking collar 132 clockwise. The horizontal guide track 112 slides clockwise with respect to the locking pin 130 until the locking pin 130 contacts the stop 114 at the end of the horizontal guide track 112. With the locking pin 130 seated at the end of the horizontal guide track 112, the handle tube 128 is held fixed in the extended position. Furthermore, as the locking collar is twisted in the clockwise direction, the sheath 96 and associated cam rib 94 also twist in unison. Eventually, the contact edge 124 of the cam rib 94 guides the cam follower 92 inwardly towards the center of the cavity 44 until axis "A" 100 of the cylindrical pad 98 becomes aligned with axis "B" 150 of the upper push rod 148 so that depressing the trigger once again can transmit downward displacement of the trigger 142 and upper push rod 148 to the engagement lever 84 and associated intermediate and lower push rods 72, 58, respectively.

The invention has been specifically described in connection with certain specific embodiments related to an upper handle assembly that can be moved from a use to a storage position while simultaneously engaging and disengaging a push rod system that is adapted to selectively actuate a fluid control valve for distributing fluid through the fluid delivery system. However, alternate configurations have been contemplated that achieve the desired function in different ways.

For example, in one alternate embodiment, a spring biased locking pin can be pivotally mounted to the upper rear housing and configured to selectively engage the handle tube in either of an upper or lower receiving hole formed in the perimeter of the handle tube. A lower portion of the handle tube comprises a cam rib similar to that previously disclosed. The cam rib selectively engages an engagement lever that is operably connected to an intermediate push rod as previously described. In operation, a user depresses the spring biased locking pin to release the extended handle tube. The user then twists the tube and in so doing, the cam rib pushes the engagement lever out of the path of the push rod that is slidably mounted inside the handle tube. Accordingly the push rod and valve actuation system becomes disengaged and the handle tube can be stowed within the handle housing. The spring biased locking pin engages an upper hole in the handle tube when the tube is seated in its lowermost stowed position.

In another alternate embodiment, a spring biased locking pin can be pivotally mounted to the upper front housing for selectively engaging a corresponding hole in a lower portion of a handle tube. The lower portion of the handle tube is slidably retained within a housing neck at the top of the handle housing. The neck forms an integral sleeve around the handle tube. The neck is pivotally mounted to an upper forward portion of the handle housing. The pivotally mounted neck portion is adapted to selectively pivot forwardly together with the entire upper handle assembly mounted thereto, thereby disconnecting the push rod and valve actuation system and simultaneously collapsing the handle assembly. Accordingly, the upper handle assembly can be folded towards the front of the handle housing until it ultimately rests thereon. In operation, to stow or fold the upper handle assembly downwardly, a user depresses the spring biased locking pin to disengage the locking pin from the hole in the handle tube. Next, the user slides the handle tube upwardly a slight distance, within the sleeve that is integral to the pivoting neck portion. Finally, a user folds the upper handle and neck portion forwardly until the upper handle rests on the front surface of the handle housing.

Finally, in a third alternate embodiment, a rotating dial is rotatably mounted to the upper front housing and rotatable between either of a "handle extended" or a "handle stowed" position. The upright handle tube slides through a corresponding oblong channel on the dial body that protrudes inside the handle housing. An L-shaped engagement lever is mounted to a lower portion of the dial body and is adapted to be selectively rotated into and out of the path of the handle tube and associated upper push rod. In operation, when the dial is rotated in a clockwise direction to the "handle extended" position and the handle tube is extended to its uppermost position, the engagement lever is rotated into the path of the handle tube and upper push rod. Furthermore, the push rod is in register with the top side of the engagement lever. Moreover, the bottom side of the engagement lever is also in register with a pivoting member in the handle housing that is configured to selectively transmit displacement of the upper push rod to an intermediate pushrod and valve actuation system. When a user rotates the dial counterclockwise to the "handle stowed" position, the dial body rotates counterclockwise and moves the engagement lever away from the handle tube and push rod, hence disengaging the upper push rod and the pivoting member and associated intermediate push rod and valve actuation system. Accordingly, the rotating dial and associated engagement lever operate to selectively extend or stow the handle tube while simultaneously engaging or disengaging the push rod and fluid delivery valve actuation system.

In addition, the invention has been described with respect to a flow controller 53 with a push-rod controlled mechanical valve 68, the invention is equally applicable to a flow controller with a push-rod controlled electrical switch, as for example, disclosed in WO2011019814, U.S. Pat. No. 6,658,692 and US2010/0287716.

The invention is described an illustrated herein with respect to an embodiment comprising an upright extraction cleaning machine, although the invention can also be utilized in other floor cleaning devices in which fluid is dispensed with a handle-operated push rod for applying a cleaning fluid to a floor surface such as steam mops and wet mops, or canister-type cleaning machine, or dry vacuum cleaning machines as well. Moreover, while the invention has been specifically described in connection with certain specific embodiments thereof, it is to be understood that this is by way of illustration and not of limitation, and the scope of the appended claims should be construed as broadly as the prior art will permit.

What is claimed is:

1. A surface cleaning apparatus comprising:

a base, which is adapted to move along a surface to be cleaned;

an upright handle assembly pivotally mounted to the base and including an upright housing at a lower portion thereof, a handle tube extending upwardly from an upper end of the upright housing and a push rod that is axially slidable within the handle tube; wherein the handle tube is mounted for axial movement within upright housing between an extended position in which at least a portion of the handle tube extends outside of the upright housing and a stowed position in which the portion of the handle tube is received within the upright housing; and a fluid delivery system including:

a fluid supply tank for holding a supply of a cleaning fluid;

a fluid distributor for distributing the cleaning fluid from the fluid supply tank onto the surface to be cleaned; and a fluid conduit, including a fluid flow controller, between the fluid supply tank and the fluid distributor;

wherein the upright handle assembly further comprises a connector that is mounted for selective movement between a connected position, in which the push rod and the fluid flow controller are connected for selective control of the fluid flow controller, and a disconnected position, in which the push rod and the fluid flow controller are disconnected.

2. The surface cleaning apparatus according to claim 1 wherein the connector is in the connected position when the handle tube is in the extended position and is in the disconnected position when the handle tube is in the stowed position.

3. The surface cleaning apparatus according to claim 1 wherein the upright handle assembly further comprises a handle grip mounted to an upper end of the handle tube and a manual actuator that is connected to the push rod for selective axial movement of the push rod when the handle tube is in the extended position for controlling the flow of fluid between the fluid supply tank and the distributor.

4. The surface cleaning apparatus according to claim 1 wherein the fluid flow controller is a valve.

5. The surface cleaning apparatus according to claim 4 where the valve is a mechanically operated valve that is opened by axial movement of the push rod when the connector is in the connected position.

6. The surface cleaning apparatus according to claim 4 where the valve is an electrically operated valve that is opened by axial movement of the push rod when the connector is in the connected position.

7. The surface cleaning apparatus according to claim 1 wherein the connector comprises a lever that is pivotally mounted for movement between an aligned position in which it is in registry with the push rod and a misaligned position in which it is out of registry with the push rod.

8. The surface cleaning apparatus according to claim 7 wherein the upright housing further comprises a collar that is mounted to the upper end thereof for rotational motion and that receives the handle tube in a central opening thereof; and a sheath rotationally mounted to the collar, at least partially surrounding the push rod, and keyed to the collar for rotation therewith, and the sheath includes a cam rib that is configured to operably contact and move the lever between the aligned position and the misaligned position.

9. The surface cleaning apparatus according to claim 8 wherein the lever it biased into the aligned position.

10. The surface cleaning apparatus according to claim 1 wherein the fluid distributor further comprises a steam generator in the fluid conduit.

11. The surface cleaning apparatus according to claim 1 and further comprises a fluid recovery system for recovering soiled cleaning fluid from the surface to be cleaned.

12. The surface cleaning apparatus according to claim 1 wherein the fluid supply tank is mounted to the upright housing.

13. The surface cleaning apparatus according to claim 1 wherein the upright housing further comprises a locking mechanism to selectively lock the handle tube in at least one of the extended and stowed positions.

14. The surface cleaning apparatus according to claim 13 wherein the locking mechanism comprises a locking collar that is rotatably mounted to the upright housing and that receives the handle tube in a central opening of the collar.

* * * * *